US005372385A

United States Patent [19]

Sufuentes et al.

[11] Patent Number: 5,372,385

[45] Date of Patent: Dec. 13, 1994

[54] DOUBLE-SIDED CARD

[75] Inventors: Joaquin Sufuentes, Glendale; Ronald S. Vaisbort, Los Angeles, both of Calif.

[73] Assignee: Know-Ware Concepts, Inc., Encino, Calif.

[21] Appl. No.: 965,002

[22] Filed: Oct. 19, 1992

[51] Int. Cl.[5] ..... B42D 15/00

[52] U.S. Cl. ..... 283/62; 283/2; 283/5

[58] Field of Search ..... 281/2, 5; 283/62

[56] References Cited

U.S. PATENT DOCUMENTS 3,744,820 7/1973 Porter ..... 251/5 X
4,627,994 12/1986 Welsh ..... 281/2 X
4,696,843 9/1987 Schmidt ..... 281/5 X
4,802,692 2/1989 Stryd ..... 281/2 X
4,955,640 9/1990 Anderson ..... 281/5 X

*Primary Examiner*—Paul A. Bell

[57] ABSTRACT

A double-sided card is provided which permits a user to print information on both sides of the card. The card has a write-in space including primary and secondary printing faces. An adhesive strip is provided on the back of both the primary and secondary printing faces. A score line divides the primary and secondary printing faces. The card can be folded along the score lime, and sealed by contact between the adhesive strips. Information printed on the primary and secondary printing faces would appear on both sides of the card after folding.

13 Claims, 7 Drawing Sheets

DOUBLE-SIDED CARD

BACKGROUND OF THE INVENTION

School children, homemakers, business people, and graduate students can all benefit from the advent of the double-sided card. Previously, if a person wanted to harness the power and productivity of computers to produce large quantities of neat and legible cards with information printed on both sides of the card, he or she would be constrained from optimal productivity and efficiency in producing double-sided cards by the need to reverse the cards through the printer and align the corresponding information from the front to the newly printed information on the back. This cumbersome process dissuades many individuals from even attempting to produce double-sided cards. Numerous card users have been ignored and their work made more difficult and inefficient. For example, students could not print double-sided flash cards from computer databases to use as study aids. Homemakers were restricted in the length of recipes to those that could only be readily printed on single sided cards. Business people could not effectively print daily schedules for appointment books on double-sided sheets. School children developing personalized books for themselves were restricted to using single sides of a page. U.S. Pat. No. 5,100,326 illustrates the need for double-sided cards as study aids although it does not suggest how a person can produce his or her own cards, in large quantities, neatly and legibly, using mechanical printing devices.

The invention being presented will mitigate all the problems and inefficiencies associated with the printing of information by computer printers and other single surface printing devices. With the double-sided cards incorporated into a continuous feed web (for dot matrix, daisy wheel, thermal label printers, as well as other devices) and in single sheets for laser printers, the user merely prints whatever data necessary on the two printing surfaces. The user then separates the double-sided card from the delivery mechanism (continuous web, sheet of paper, other scrolling mechanism). The release coated surfaces on the back of both printing faces are then removed to expose the adhesive. The double-sided card is subsequently folded along a score line so that the adhesive backs adhere to each other and maintain the double-sided card structure. The user then has a card with the chosen information depicted on both sides of the same card. This simple process can be easily repeated to produce large quantities of double-sided cards for any purpose.

Presently, there is no existing method by which cards, or any other form of sheet paper, can accommodate indelible printing, from a continuous feed computer printer or a single feed laser printer, on both sides of the same card or sheet. Accomplishing double-sided printing, under present constraints, requires the flipping and refeeding of the already printed cards or sheets, alignment of the information to be printed so that it conforms with the complimentary data on the opposite printed side, and a relatively heavy card or paper stock so that the printing does not show through to the other side. These are cumbersome and technically inefficient tasks. The utility of the double sided printing capability provided by this invention is that it allows for additional storage of information on a singular card or sheet, and it also allows greater flexibility and efficiency in the utilization of cards or sheets of paper, while overcoming the burdens and technical problems of manually reversing the existing continuous feed or single feed cards and sheets, to achieve double-sided printing capability.

The present invention provides a computer printable double-sided reference card which allows the user to print on successive cards, detach the complimentary portions as a whole from the continuous feed web or the single sheet, remove the release coated surface covering the pressure sensitive adhesive on the back of the cards, and fold them onto themselves, thus providing interrelated information on a double-sided card. The invention can be manufactured at a low price using existing technology and processes. The low cost would allow for wide dissemination of the cards to schools, students, offices, and homes.

The double-sided cards can be manufactured by applying an adhesive to the back of continuous web index cards. Thus, every two individual index cards would comprise the entirety of a double-sided card. If the adhesive were pressure sensitive, it would be covered by a release coated surface. In the single sheet format, a sheet of card stock would be perforated to outline the boundaries of the double-sided card. The adhesive would be applied to the designated back of the sheet and a release coated surface applied as needed. To form the double-sided card after applying the printed matter, the user would tear out the card along the perforations, expose the adhesive, and fold the adhesive surfaces onto themselves.

SUMMARY OF THE INVENTION

Briefly, the double-sided card comprising this invention includes a substrate with a front and back, with the front being characterized by a primary printing face and a secondary printing face, which faces both accommodate printed material. The substrate is generally assumed to be composed of a paper or card stock material and bearing no specific geometric shape. Adhesive material is provided on the back opposite the printing faces of the substrate. By adhesive, it is assumed a pressure sensitive adhesive, moistenable adhesive, double-sided adhesive tape is utilized, but the intention is not limited to these forms of adhesive. Means are provided to facilitate folding of the substrate so that one half of the back contacts with the adhesive on the second half of the back for sealing the backs together inside the folded substrate. Thus, the computer printed information can be provided on the first side of the substrate having the exposed non-adhesive surface, and the card can be folded and secured by the adhesive so that only the printed information is exposed on the primary and secondary printing surfaces.

The methods of delivery for the substrate of the double-sided card include a continuous feed web and single sheets. The continuous web delivery system allows for the continuous flow of double-sided cards through mechanical printing devices. Mechanical printing devices include, but are not limited to, daisy wheel, dot matrix, and thermal printers. The single sheet delivery system is the preferred embodiment for laser printers and other devices characterized by a cartridge housing single sheets of paper to be fed to the printing device.

Once information is printed on the printing faces of the substrate, the user separates the substrate from the delivery mechanism along the perforations characteristic of the particular format. The next step toward full implementation of the double-sided card is activation of the adhesive on the back of the substrate. In the case of a pressure sensitive adhesive, activation is achieved by removing the release coated surface. If a moistenable adhesive is employed, activation involves moistening the adhesive area. Subsequently the adhesive side of the substrate is folded onto itself along the score line. The score line is designed to facilitate folding and may include a perforation or pleat, but is not limited to these designs. The resulting folded substrate exposes the printed information on the open faces of the double-sided card.

These and other aspects of the invention will be more fully understood by referring to the following detailed description and accompanying drawings.

DRAWING

FIG. 1 is a top plan view showing a double-sided card for continuous feed printing process according to this invention;

FIG. 2; is a bottom plan view showing a double-sided card for continuous feed printing process according to this invention;

DETAILED DESCRIPTION

Figure 1:
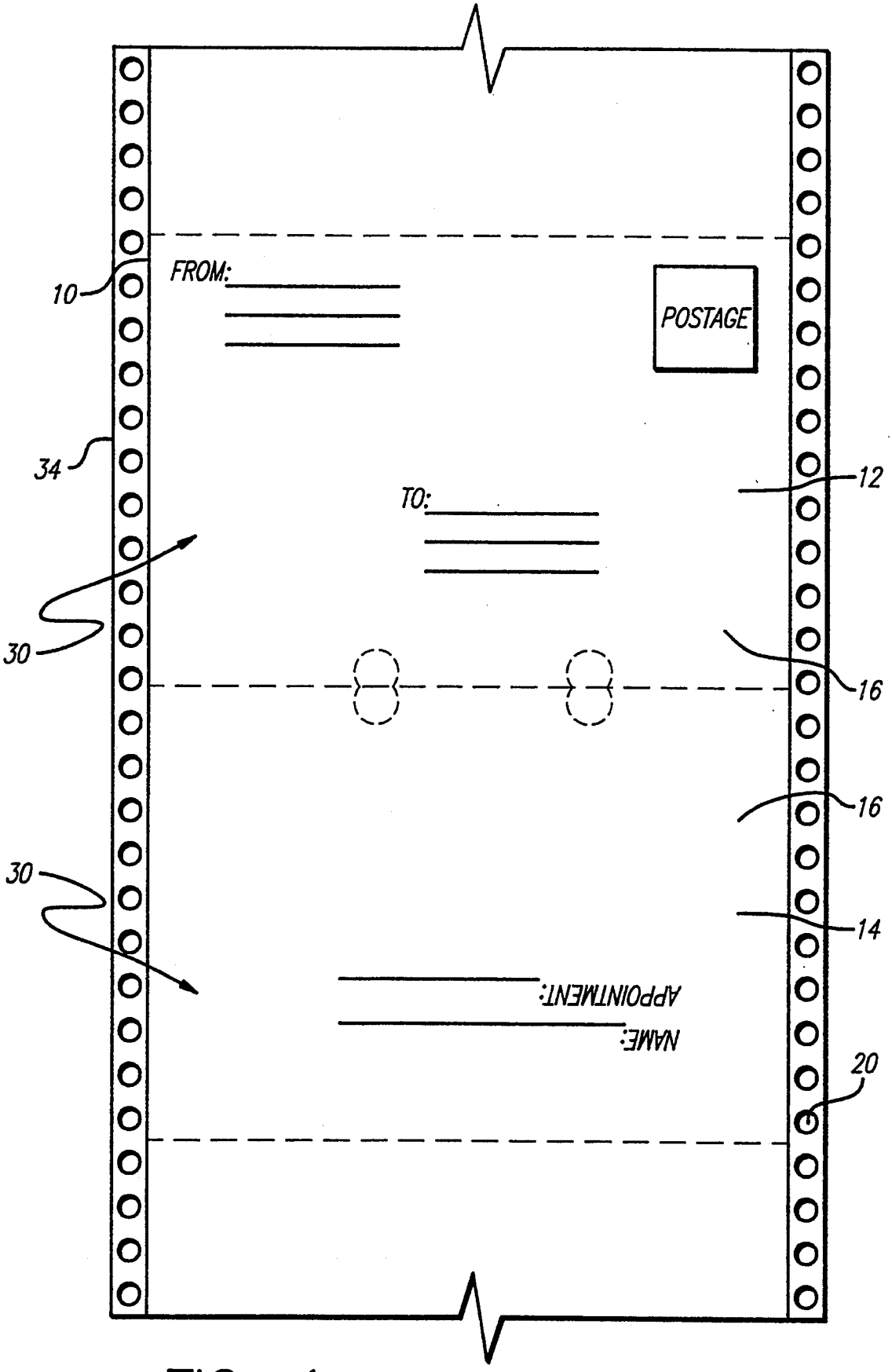
Figure 2:
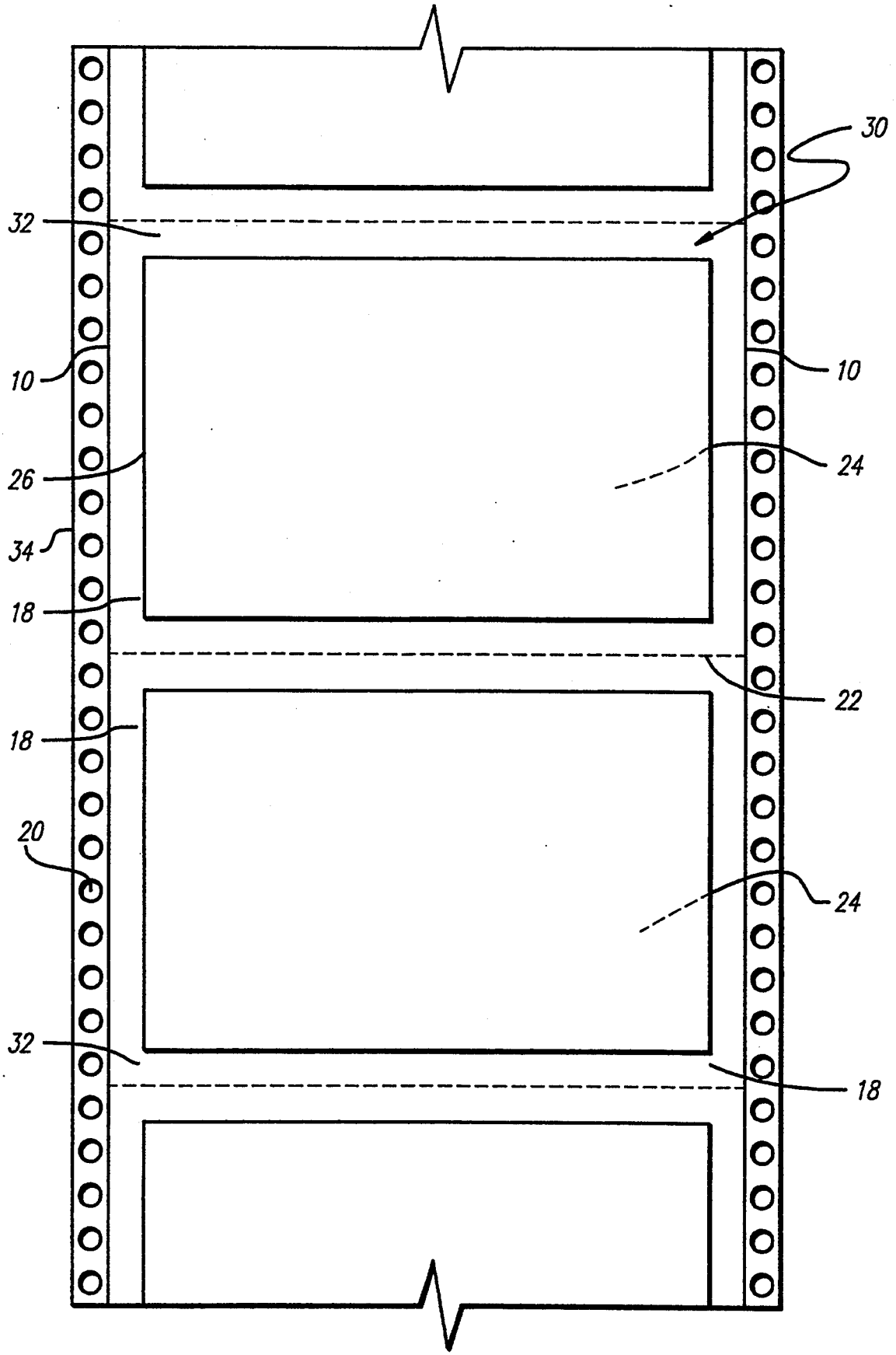
Figure 3:
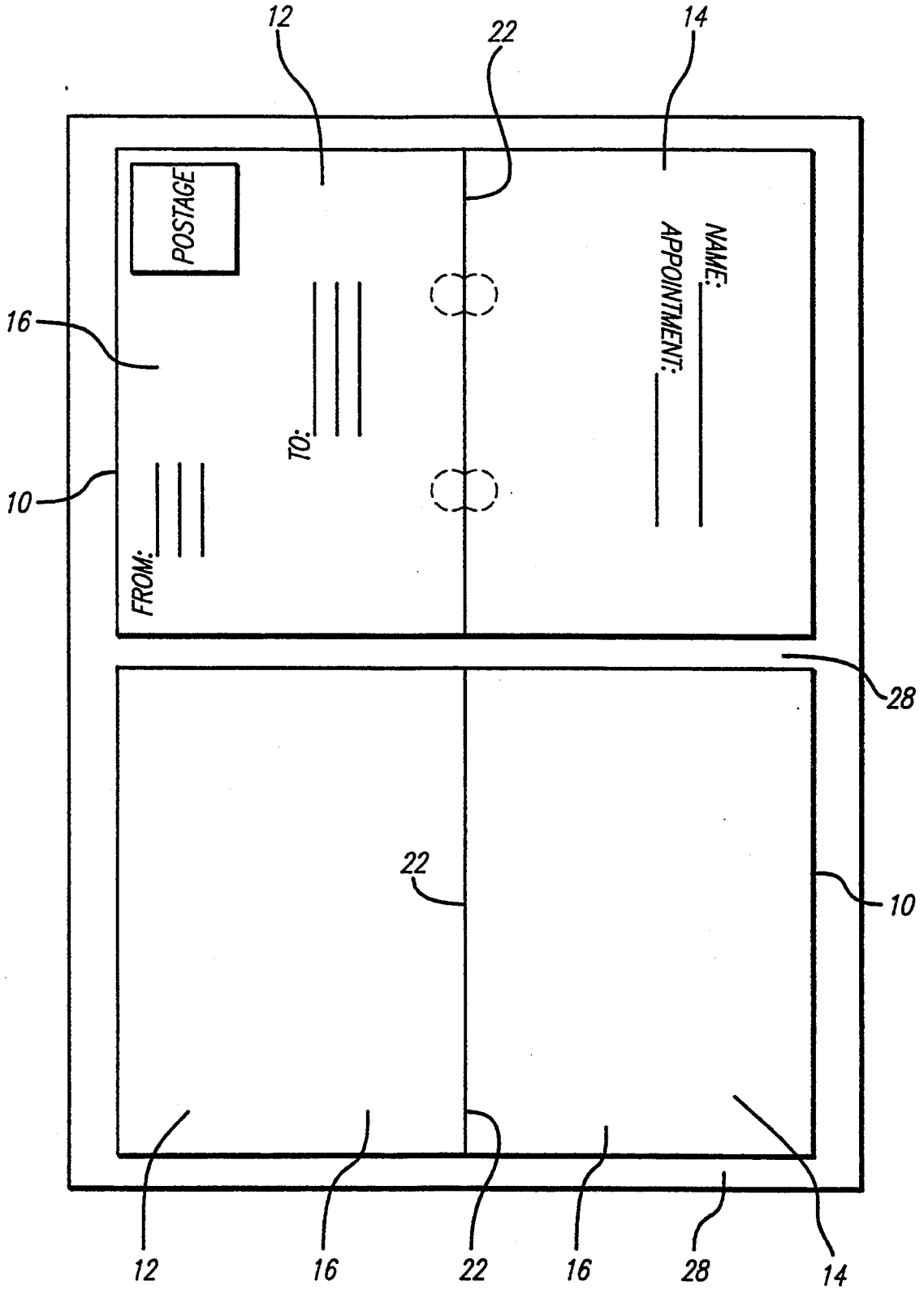
FIG. 3 is a top plan view showing a double-sided card for laser printing process according to this invention.
Figure 4:
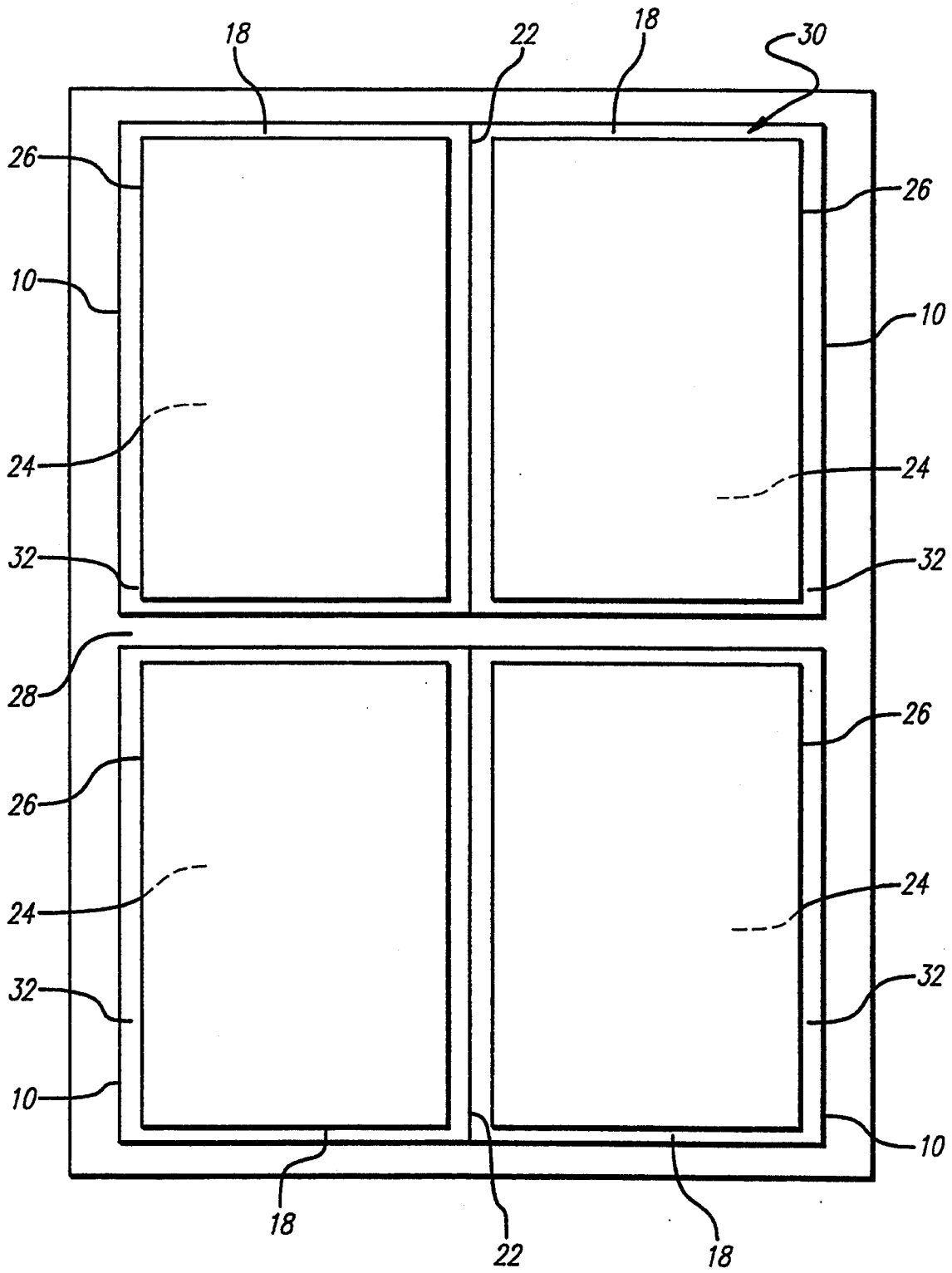
FIG. 4 is a bottom plan view showing a double-sided card for laser printing process according to this invention.
Figure 5:
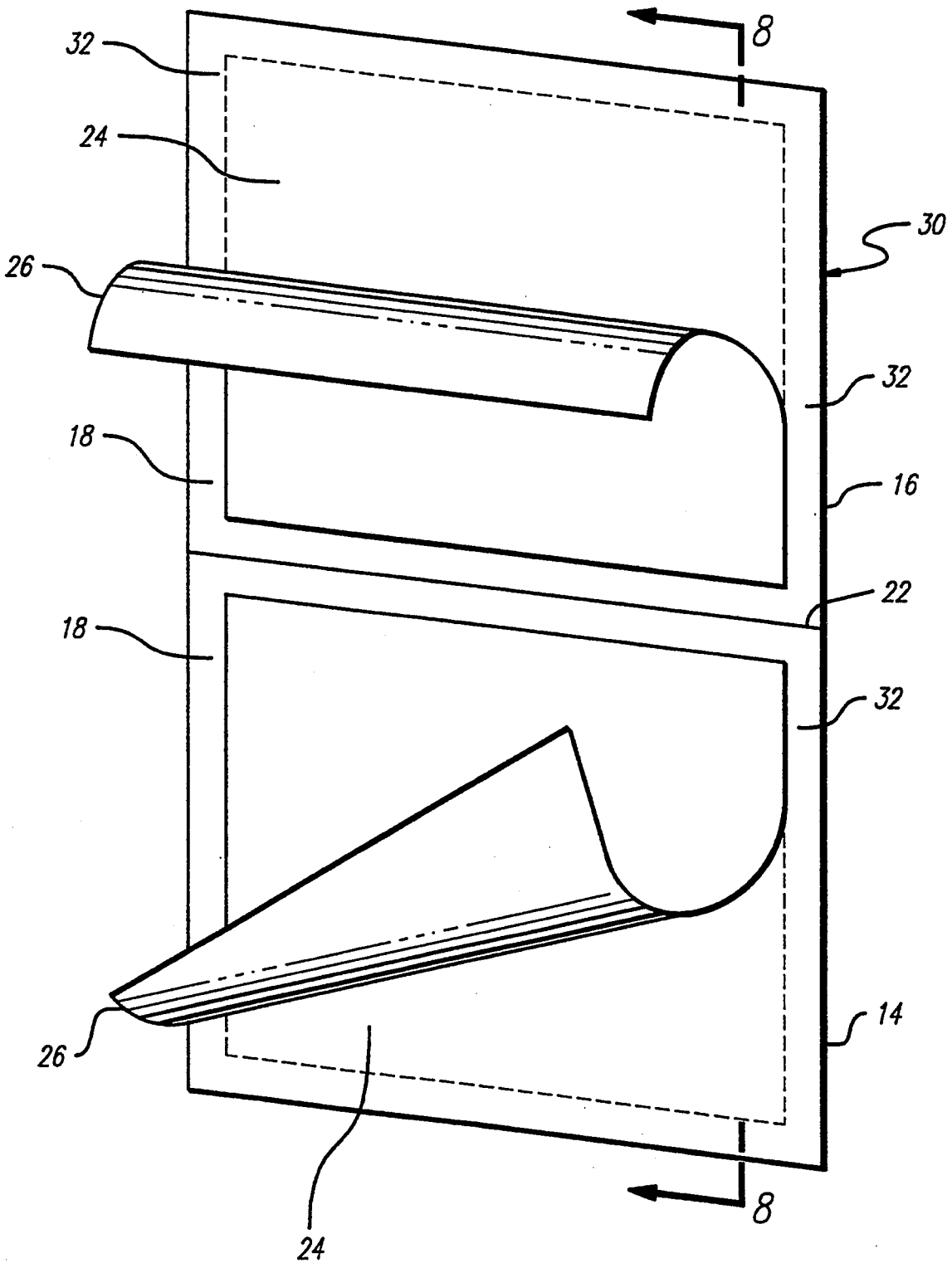
FIG. 5 is an illustration of the release coated surface tearing away from the double-sided card.
Figure 6:
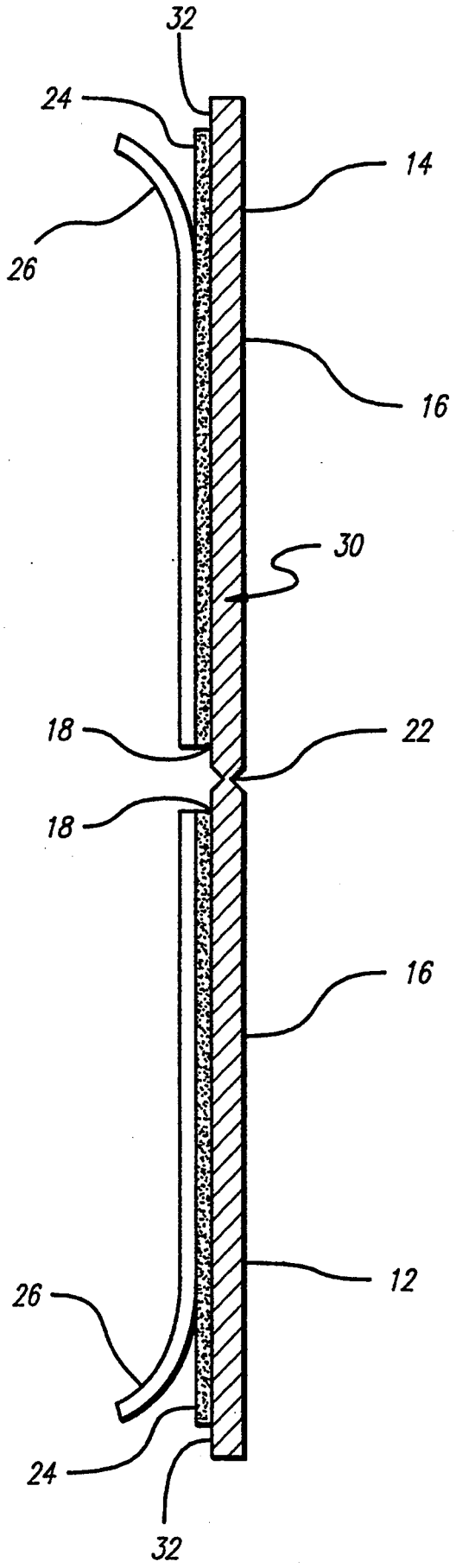
FIG. 6 is a fragmentary schematic cross-sectional view exaggerated in size and taken along the line 2 of FIG. 5.
Figure 7:
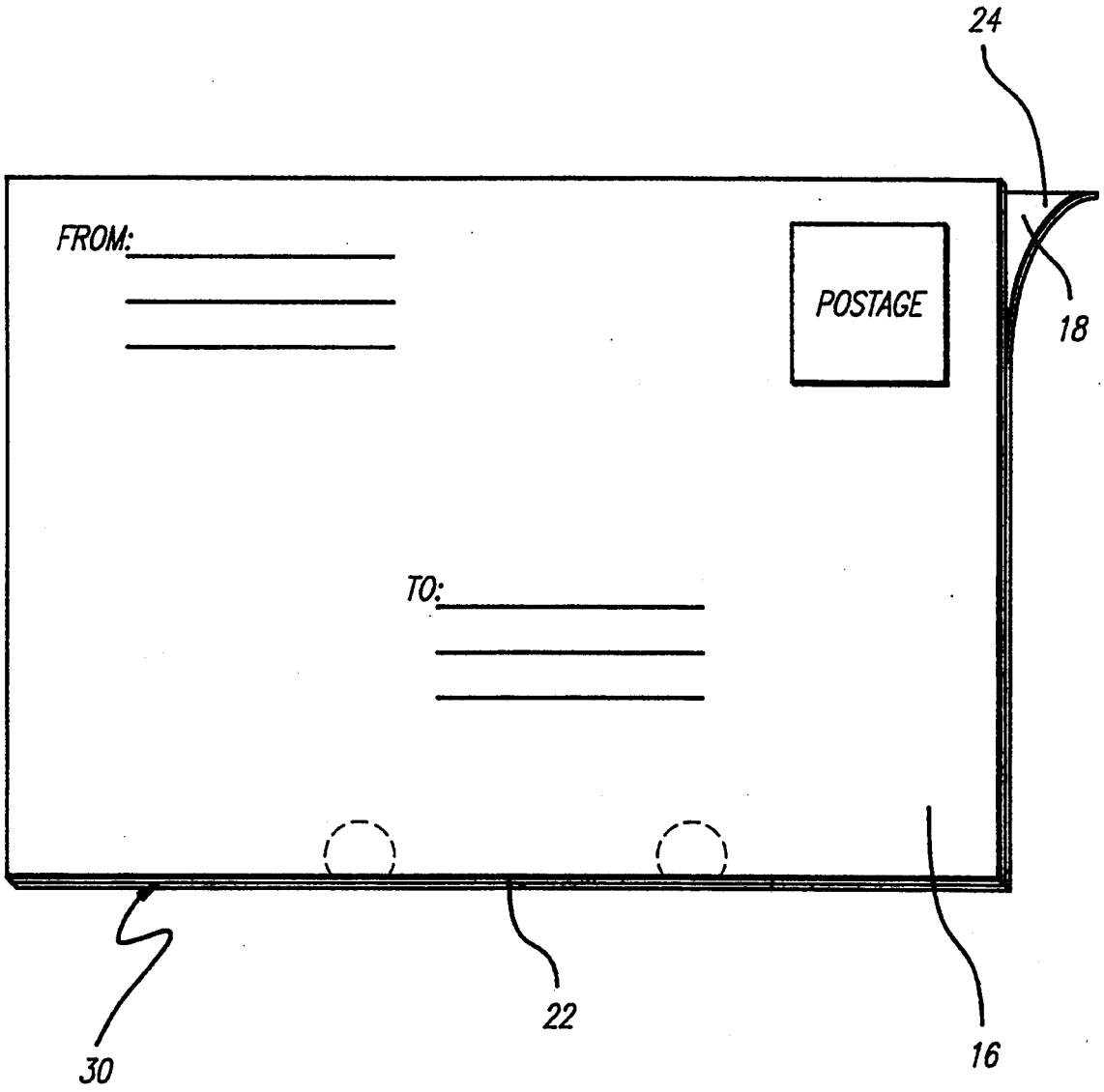
FIG. 7 is a perspective view showing a folded position of the double-sided card.

Referring to the drawing, a double-sided card includes a thin foldable, geometric substrate 30. In the preferred embodiment, the substrate base is made of paperboard, preferably of at least 18 point thickness. The substrate has a flat front 16 shown in FIGS. 1–7 and an opposite flat back 18 shown in FIGS. 1–7.

The front of the substrate may or may not contain visual indicia and perforations. The substrate is thus formed from a material such as paperboard card stock, capable of receiving typewritten or computer printed information from a mechanical printing device such as a dot matrix, daisy wheel, or laser printer. The substrate material also is capable of receiving handwritten information, such as from a pen or pencil.

A marginal edge line (score line or fold line) 22 extends approximately along the midpoint of the entire substrate. In the illustrated embodiment, the marginal edge line 22 extends across the entire width of the substrate in a direction parallel to the long edges of the substrate, although the two halves of the substrate can be folded in a side by side method, with the marginal edge line 22 extending across the entire width of the substrate in a direction parallel to the short edges of the substrate.

A first adhesive layer 24 is provided on the back of the first printing surface 12 of the substrate. A second adhesive layer is provided on the back of the second printing face 14 of the substrate. The adhesive layer and the marginal edge line 22 are arranged so that the substrate can be folded along the marginal edge line to enable the substrate to be folded essentially in half, with the adhesive on the back of the primary printing face 12 being able to overlap the adhesive layer on the back of the second printing face 14. In the illustrated embodiment, the pressure sensitive adhesive extends across a designated dimension of the back of the primary and secondary printing faces of the substrate. Alternatively, the pressure sensitive adhesive may be placed on only one back of a printing face. A flexible removable release coated surface 26 is releasably secured over the pressure sensitive adhesive layer 24 for providing a protective backing until the adhesive is used. The adhesive layer 24 could also be moistened activated rather than pressure sensitive.

The pressure sensitive adhesive can be spaced inwardly from the adjacent edges of the substrate to provide a marginal region 32 of varying size and geometry, in order to ease manual folding and prevent air bubbling within the folded card.

In utilizing the double-sided card, the individual user prints, by mechanical printing device, on either the primary or secondary printing faces, or both. These printing faces are located on the front of the substrate. The substrate is subsequently removed from the single sheet 28 or continuous web of cards 34 along the perforated tear lines 10. The protective backing (release coated surface) 26 of the pressure sensitive adhesive is then removed to expose the layer of pressure sensitive adhesive 24, and the substrate is folded in half along the marginal edge line (fold line) 22 so the adhesive backing corresponding to the primary printing face of the substrate 12 overlies the adhesive backing corresponding to the secondary printing face of the substrate 14. The congruent adhesive backings are then pressed firmly against each other to seal the substrate into one card unit. This leaves the first printing face 12 and the second printing face 14 outwardly exposed and facing directly opposite sides. The substrate can now be formally recognized as a double-sided card. The user has data visually represented on both sides of the card. The card can be easily stored and will be space efficient given its double-sided storage capacity. Perforations within the substrate can be used to bind the card within a binder, file, and book format.

What is claimed is:

1. A double-sided card comprising:

a substrate having a front and an opposite back;

a write-in space of said front having adjacent primary and secondary printing faces, the write-in space providing a surface capable of receiving printed information from a printing device;

adhesive means on the back of both the primary and secondary printing faces for securing said card in a folded configuration;

a score line extending across the substrate between the primary and secondary printing faces for facilitating folding of the substrate, the adhesive means on the back of the primary printing face contacting the adhesive means on the back of the secondary printing face, the adhesive means permitting the folded substrate to be sealed and depict the printed information on opposite sides of the folded substrate.

2. The double-sided card according to claim 1 wherein said substrate comprises paper.

3. The double-sided card according to claim 1 wherein the adhesive means comprises a pressure sensitive adhesive layer and a release coated surface.

4. The double-sided card according to claim 1 wherein the adhesive comprises a moistened adhesive surface.

5. The double-sided card according to claim 1 further comprising visual indices provided on the primary and secondary printing faces designating printing areas for names, dates, numbers, and other relevant user information.

6. The double-sided card according to claim 1 further comprising perforations constructed within the boundary of the card for fastening, binding, and retaining cards in a collection format such as a ring binder, book, and file system.

7. The double-sided card according to claim 1 wherein the substrate comprises a geometric shape, said score line symmetrically dividing said substrate.

8. A double-sided card comprising;

a substrate having a front and opposite back;

a printable surface on the front of the substrate for information data to be provided on said front of the substrate, the front of the substrate having primary and secondary printing faces on adjacent sides of the substrate;

adhesive provided on the back of the substrate opposite the primary and secondary printing faces;

means facilitating folding of the substrate so the adhesive on the back of the primary face contacts the adhesive on the back of the secondary printing face, and for sealing the printing faces on the outside of the folded substrate.

9. The double-sided card according to claim 8 wherein the adhesive comprises an adhesive layer on the back of the substrate opposite the front, primary and secondary printing faces.

10. The double-sided card according to claim 8 wherein the means facilitating folding symmetrically divides the substrate.

11. The double-sided card according to claim 8 further comprising visual indices disposed on the primary and secondary printing faces for identification, indication, and separation of user relevant information.

12. The double-sided card according to claim 8 further comprising perforations constructed within the boundary of the card for fastening and binding the card to other materials.

13. A double-sided card comprising:

a paper substrate having a front and an opposite back;

a write-in space of said front including adjacent primary and secondary printing faces capable of receiving printed information from a printing device;

a pressure sensitive adhesive strip provided on the back of both the primary and secondary printing faces;

a score line extending across the substrate between the primary and secondary printing faces for facilitating folding of the substrate so the pressure sensitive adhesive strip on the back of the primary printing face contacts the pressure sensitive adhesive strip on the back of the secondary printing face;

wherein, printed information can be provided in said write-in space on the outside of the folded substrate, the pressure sensitive adhesive strips permitting the folded substrate to be sealed and depict the printed information on opposite sides of the folded substrate.

* * * * *